US008605553B2

(12) United States Patent
Chaignat et al.

(10) Patent No.: US 8,605,553 B2
(45) Date of Patent: Dec. 10, 2013

(54) ANNUAL CALENDAR DEVICE FOR A TIMEPIECE

(75) Inventors: Julien Chaignat, Macolin (CH); Stefan Rombach, Bienne (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 47 days.

(21) Appl. No.: 13/348,812

(22) Filed: Jan. 12, 2012

(65) Prior Publication Data

US 2012/0188852 A1 Jul. 26, 2012

(30) Foreign Application Priority Data

Jan. 24, 2011 (EP) ..... 11151879

(51) Int. Cl.
*G04B 19/20* (2006.01)

(52) U.S. Cl.
USPC ..... 368/38; 368/220

(58) Field of Classification Search
USPC ..... 368/28, 35–38, 220
See application file for complete search history.

(56) References Cited

U.S. PATENT DOCUMENTS

| | | | | |
|---|---|---|---|---|
| 3,673,789 | A * | 7/1972 | Tsuzuki et al. | 368/37 |
| 5,432,759 | A * | 7/1995 | Vaucher | 368/28 |
| 6,108,278 | A * | 8/2000 | Rochat | 368/28 |
| 8,111,587 | B2 * | 2/2012 | Watanabe | 368/37 |
| 2003/0165083 | A1 * | 9/2003 | Maruyama et al. | 368/28 |
| 2006/0002237 | A1 * | 1/2006 | Takahashi | 368/28 |
| 2006/0120219 | A1 | 6/2006 | Ruefenacht | |
| 2010/0135125 | A1 | 6/2010 | Watanabe | |

FOREIGN PATENT DOCUMENTS

EP 1666991 A1 6/2006

OTHER PUBLICATIONS

European Search Report of EP 11 15 1879 dated Jul. 26, 2011.

* cited by examiner

*Primary Examiner* — Sean Kayes
(74) *Attorney, Agent, or Firm* — Sughrue Mion, PLLC

(57) ABSTRACT

The annual calendar device carries a date ring (1) and a drive wheel (5) for said ring. The drive wheel (5) carries a mechanism (10) including a first finger (6) driving the ring (1) through one step each day and a second finger (7) which is inserted, at the end of the months of less than thirty-one days, into the trajectory of the teeth (4) of the ring (1) to move said ring forward one additional step. The second finger (7) is inserted into said trajectory by a kinematic chain (9) controlled by a toothing (8) carried by the ring (1).

4 Claims, 5 Drawing Sheets

ANNUAL CALENDAR DEVICE FOR A TIMEPIECE

This application claims priority from European Patent Application No. 11151879.1 filed Jan. 24, 2011, the entire disclosure of which is incorporated herein by reference.

BACKGROUND OF THE INVENTION

The present invention relates to an annual calendar device including a date ring bearing thirty-one numbers, which appear in succession through an aperture, said ring carrying thirty-one inner teeth located on a first level, a drive wheel for the date ring completing one revolution in twenty-four hours, and a mechanism (10) carried by said wheel (5) and rotating therewith, said mechanism (10) having a first finger, which, at the end of each day, drives one tooth of the date ring through one step.

An "annual calendar device" means a system which moves the date ring forward one additional step at the end of months having less than thirty-one days, with a manual correction remaining to be performed at the end of February. This correction is automatically performed in timepieces fitted with a so-called perpetual calendar device. Annual calendar devices are disclosed in the horological literature and, by way of example, EP Patent No. 1 666 991 will be cited here, the operation of which is summarized below.

The annual calendar mechanism disclosed in the aforecited document includes a drive wheel for the date ring, fitted with a first finger which drives a date ring once per day, and a second finger, which, at the end of months of less than thirty-one days, drives a plate with five catches secured to an annual wheel, which is arranged coaxially to the date ring. An intermediate wheel connects the annual wheel to the date ring at the end of each month. The annual wheel includes twice as many teeth as there are months in the year and the intermediate wheel includes a first wheel in mesh with the annual wheel and a second wheel fixed to the first. Said second wheel is in mesh, at the end of each month, with a catch placed inside the date ring.

From the foregoing, it will be clear that although the first finger, integrated in the drive wheel, directly drives the date ring each day, the second finger, also integrated in the drive wheel, only drives the date ring indirectly, via a kinematic chain comprising a plate with five catches, an annual wheel and an intermediate wheel formed of two superposed wheels. Said intermediate wheel finally drives the date ring through one additional step at the end of months having less than thirty-one days. It will be clear that this kinematic chain uses energy and that a considerable saving could be made if the second finger, also mounted on the drive wheel, could drive the date ring directly, with no intermediate part, at the end of months of less than thirty-one days. It is an object of the present invention to make this saving.

SUMMARY OF THE INVENTION

Thus, in addition to conforming to the generic definition set out in the first paragraph of this description, the present invention is remarkable in that the mechanism carried by the date drive wheel has a second finger driving the date ring through an additional step at the end of the last day of a month of less than thirty-one days, said second finger being activated, for the purpose of said driving, by a toothing located on a second level of the date ring, said second finger being connected to said toothing by a suitable kinematic chain.

It will also be mentioned that the present invention has another advantage, in that it only requires two jumper springs instead of three as is common in known state of the art embodiments.

BRIEF DESCRIPTION OF THE DRAWINGS

The features and advantages of the present invention will appear from the following description, given with reference to the annexed drawings, and providing, by way of explanatory, but non-limiting example, an advantageous embodiment of a date ring. In the drawings.

DETAILED DESCRIPTION OF THE INVENTION

Figure 1:
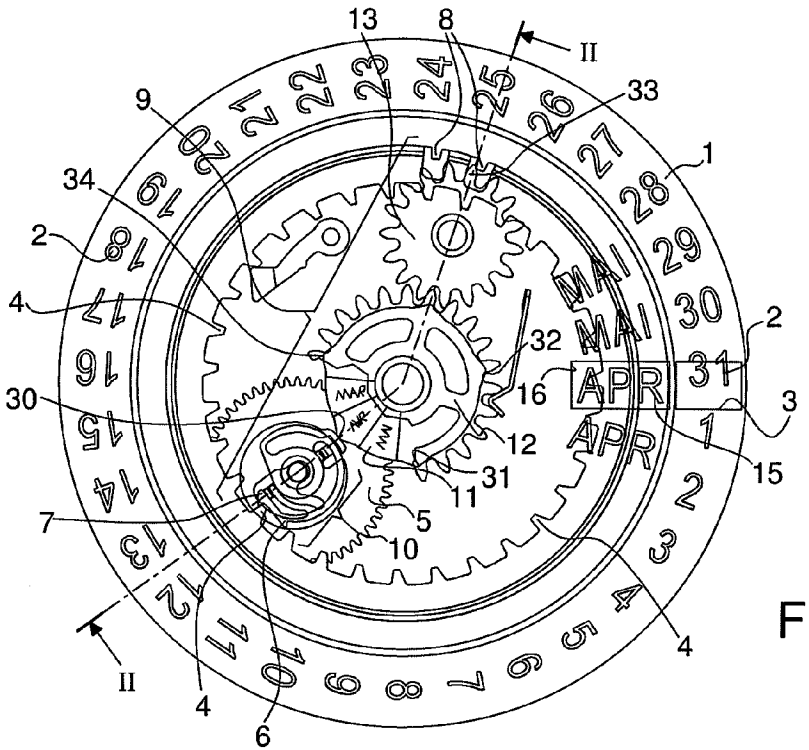
FIG. 1 is a general plan view of the annual calendar device according to the present invention.
Figure 2:
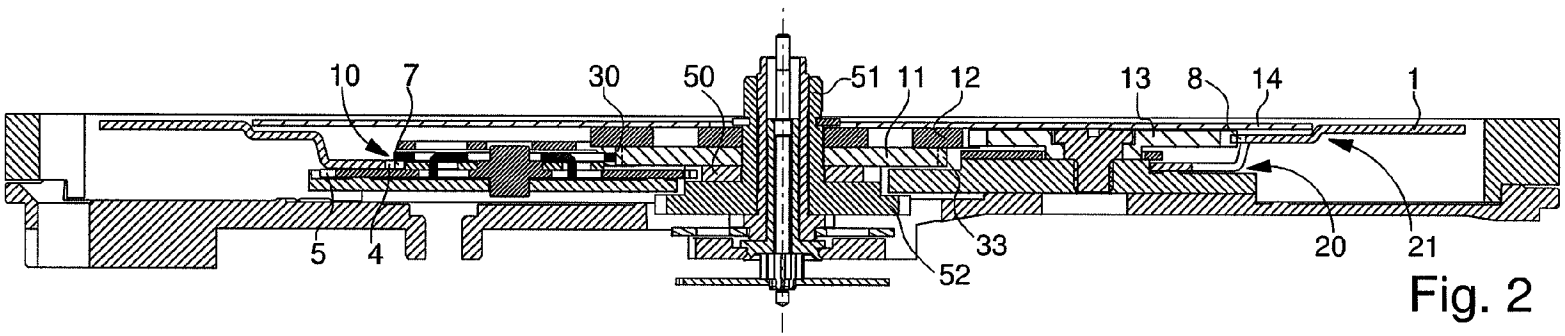
FIG. 2 is an enlarged cross-section along the line II-II shown in FIG. 1.

Reference will now be made to FIGS. 1 and 2 to explain the main idea governing the present invention. FIG. 1 is a general plan view of the date device showing the situation of the mechanism chosen at time t5, i.e. the first of May at 0115 hours and FIG. 2 is an enlarged cross-section of the same device taken along line II-II of FIG. 1. The annual calendar device includes a date ring 1 bearing thirty-one numbers 2 which appear in succession through an aperture 3. Ring 1 carries thirty-one inner teeth 4 located, as shown in FIG. 2, on a first level 20. The device further includes a wheel 5 driving date ring 1. This wheel 5 completes one revolution in twenty-four hours, driven, as seen in FIG. 2, by a wheel 50 driven onto the pipe 51 of hour wheel 52. Drive wheel 5 carries a mechanism designated by the reference 10. This mechanism rotates with drive wheel 5 and will be described in more detail below. It has a first finger 6 which drives a tooth 4 of date ring 1 through one step, at the end of each day. This is well known in the state of the art.

Compared to the description that has just been given, the date device of the invention is characterized by a remarkable and original arrangement in that the mechanism 10, which is carried by drive wheel 5 and rotates therewith, has a second finger 7, as shown in FIGS. 1 and 2. This second finger 7, which is directly driven by wheel 5, in turn drives date ring 1 through an additional step at the end of the last day of a month of less than thirty-one days. In order to drive the date ring, second finger 7 is activated by a toothing 8, located on a second level 21 of the date ring as shown in FIG. 2, and this activation pushes finger 7 into the trajectory of teeth 4 of date ring 1. For this purpose, the Figures show that second finger 7 is connected to toothing 8 by a suitable kinematic chain 9. Thus, in the device of the invention, the date ring is also driven, at the end of months of less than thirty-one days, by a second finger 7 directly connected to drive wheel 5.

The aforementioned suitable kinematic chain 9, which controls the movement of second finger 7 to place the latter in the trajectory of teeth 4 of date ring 1 and thus to drive the ring through one step on the last day of a month of less than thirty-one days, includes the mechanism 10, which has first and second fingers 6 and 7. Said mechanism 10 and fingers 6, 7 attached thereto rotate with drive wheel 5, as seen above. The chain further includes a month cam 11, which has five projecting portions 30 and 34, each corresponding to a month of less than thirty-one days, namely the months of April, June, September, November and February. Projecting portions 30 to 34 activate second finger 7 in turn via mechanism 10. Finally, chain 9 includes a month star wheel 12 completing one revolution in a year and coaxially integral with month cam 11, and a intermediate transmission wheel 13 meshing with said star wheel 12, said intermediate wheel 13 being in mesh, at the end of each month, with toothing 8 located on the second level 21 of date ring 1.

From the explanations that have just been given, it is clear that the only function of kinematic chain 9, controlled by toothing 8 of the ring, is to insert finger 7 opposite a tooth 4 of ring 1 and not to drive said ring, since the driving is performed by finger 7, moved by date drive wheel 1.

As shown in FIG. 2, star wheel 12, integral with cam 11, carries a disc 14 on which are marked the names of the months 15 shown in FIG. 1. These names appear in succession through an aperture 16. The names appear twice and thus pass twice through the aperture at the end of each month. This slight drawback is due to the device proposed here and could be avoided by adding two extra elements thereto, which would mean that the name of the month appears only once when the month changes. To do this, an additional star wheel is fixed underneath month disc 14, mounted to rotate freely on month star wheel 12. This additional star wheel is controlled by an additional wheel fixed to intermediate transmission wheel 13, as disclosed in the aforecited EP Patent No 1 666 991. Although these additional elements allow the letters forming the name of the month to be made larger, they do, however, lead to a thicker timepiece.

The mechanism 10 carried by date drive wheel 5 and rotating therewith will now be described with more particular reference to the plan view of FIG. 3 and the cross-section of FIG. 4. This cross-section is taken along the line IV-IV of FIG. 3. This mechanism 10 was selected from among other possible mechanisms and in no way limits the scope of the present invention, the essential point being that it is associated with drive wheel 5, rotates therewith and includes first and second fingers 6 and 7, the first acting at the end of each day and the second at the end of the last day of months of less than thirty-one days.

Figure 3:
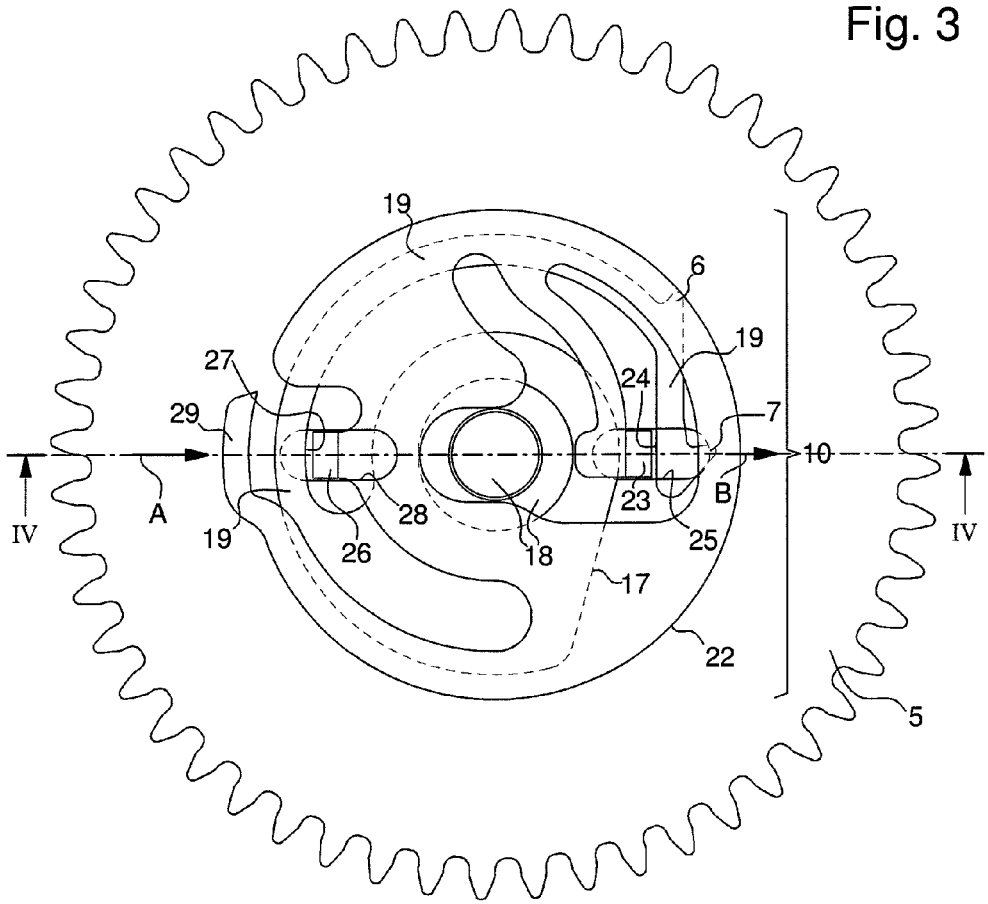
FIG. 3 is a plan view of the date drive wheel with the mechanism associated therewith. Said wheel appears only in smaller scale in FIG. 1.
Figure 4:
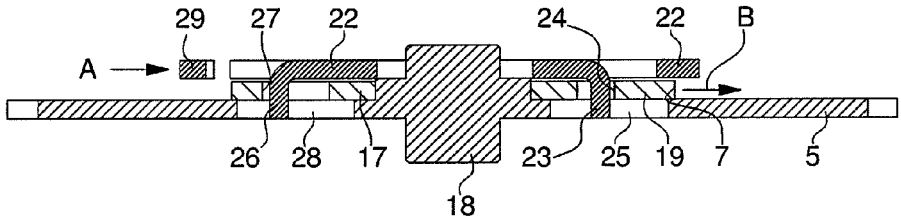
FIG. 4 is a cross-section along the line IV-IV shown in FIG. 3.

FIGS. 3 and 4 show that mechanism 10 carried by date drive wheel 5 includes a first plate 17 fixed to arbour 18 carried by drive wheel 5. On the periphery of first plate 17 there is a tongue 19 from which the first and second fingers 6 and 7 extend, the second finger 7 being arranged at the end of tongue 19. A second plate 22, which is able to move diametrically relative to the drive wheel, is arranged on first plate 17. It is held in place axially by suitable means, not shown in FIG. 4. This second plate 22 has a first catch 23 passing through the first plate 17 in proximity to the back 24 of second finger 7, then a first oblong aperture 25 made in drive wheel 5. Said second plate 22 also has a second catch 26 passing through the first plate 17 in proximity to the back 27 of tongue 19, then a second oblong aperture 28 made in drive wheel 5. This second plate 22 finally has a heel 29 diametrically opposite the first catch 23 and second finger 7. Heel 29 is arranged to be in the trajectory of projecting portions 30 to 34 of month cam 11, as shown in FIG. 1 and FIGS. 5 to 12. Thus, when heel 29 is pushed in the direction of arrow A by a projecting portion 30 of month cam 11 (see FIG. 1), the second finger 7 pushed, in turn, via first catch 23 in the direction of arrow B, enters the trajectory of teeth 4 of date ring 1 to move said ring forward through an additional step.

The operation of the annual calendar according to the invention will now be described with reference to FIGS. 5*a, b* to 12*a, b*, to explain the change from a month of less than thirty-one days to the following month, taking as example the change from April to May.

Figure 5A:
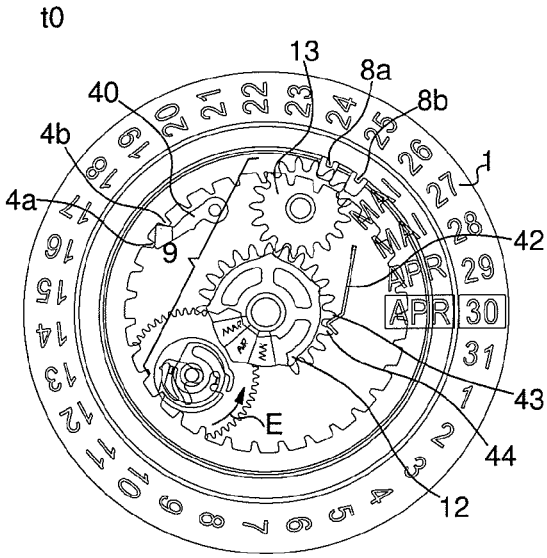
FIG. 5A shows how the annual calendar device appears on 30 April at 2200 hours and FIG. 5B shows a larger scale detail of this device on the same date and at the same hour, at time t0.
Figures 5B, 6B, 7B, 8B:
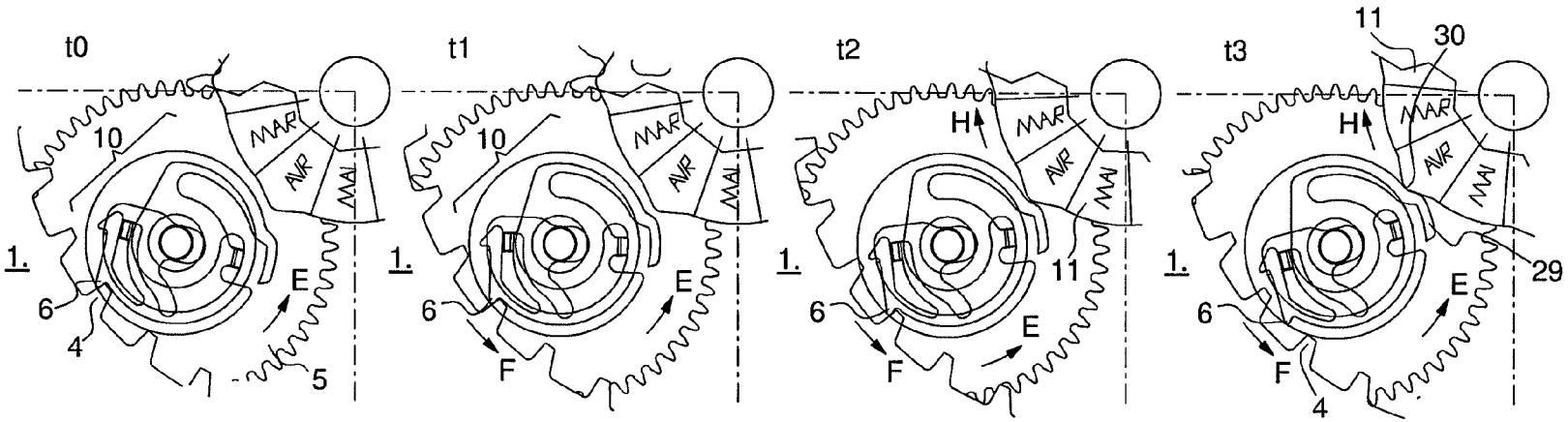

FIG. 5*a* shows how the annual calendar device looks at time t0, namely 30 April at 2200 hours, and FIG. 5B shows, at the same time t0, a larger scale detail of this device, namely mechanism 10 carried by drive wheel 5 and month cam 11 on which month star wheel 12 is mounted. Driven by the motor member of the timepiece, drive wheel 5 rotates in the direction of arrow E with the mechanism 10 which is connected thereto. At 2200 hours, finger 6 of mechanism 10 enters into contact with tooth 4 of date ring 1. Ring 1 is still at rest and a first jumper spring 40 positioning the ring is situated between two teeth 4*a* and 4*b* on first level 20 of ring 1. Toothing 8 has two teeth 8*a* and 8*b* here, located on the second level 21 of ring 1. Neither of these teeth is in mesh with intermediate transmission wheel 13, which is at rest, as is month star wheel 12 which is connected thereto. A second jumper spring 42 is located between two teeth 43 and 44 of said star wheel 12 for positioning said star wheel.

Figure 6A:
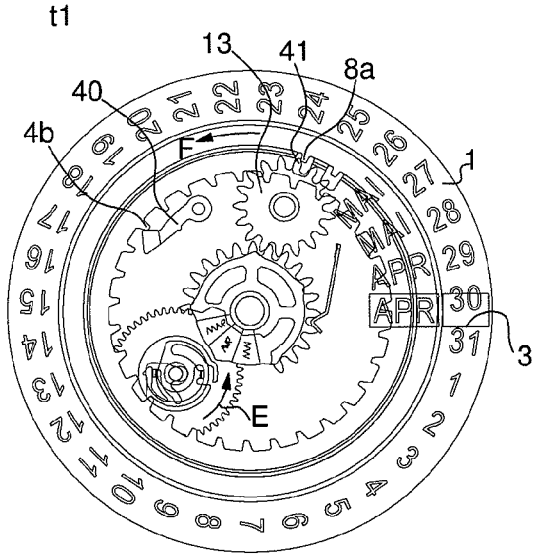
FIGS. 6*a* and 6*b* show the situation of the device on 30 April at 2245 hours at time t1.

FIGS. 6*a* and 6*b* show the situation of the device at time t1, namely 30 April at 2245 hours. As it continues to rotate in the direction of arrow E, finger 6 of mechanism 10 drives ring 1 in the direction of arrow F. The tooth of toothing 8*a* of ring 1 enters into contact with a tooth 41 of intermediate wheel 13 and jumper spring 40 climbs tooth 4*b* of ring 1. The number 30 starts to disappear from aperture 3.

Figure 7A:
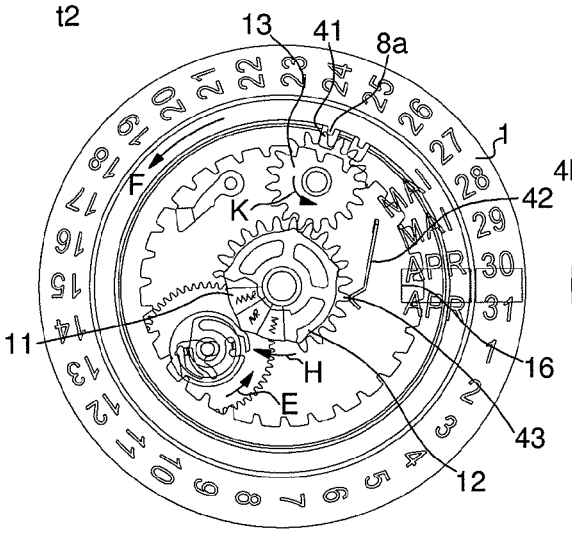
FIGS. 7*a* and 7*b* show the situation of the device on 30 April at 2320 hours at time t2.

FIGS. 7*a* and 7*b* show the situation of the device at time t2, i.e. on 30 April at 2320 hours. Since finger 6 is still being driven in the direction of arrow F, as is ring 1, tooth 8*a* drives intermediate wheel 13 in the direction of arrow K, which in turn drives star wheel 12 and cam 11, which is connected thereto, in the direction of arrow H. Month disc 14, which does not appear in these Figures, also rotates in the direction of arrow H and the first word for April APR starts to disappear from aperture 16. The number 31 starts to appear in aperture 3. Jumper spring 42 climbs tooth 43 of star wheel 12.

Figure 8A:
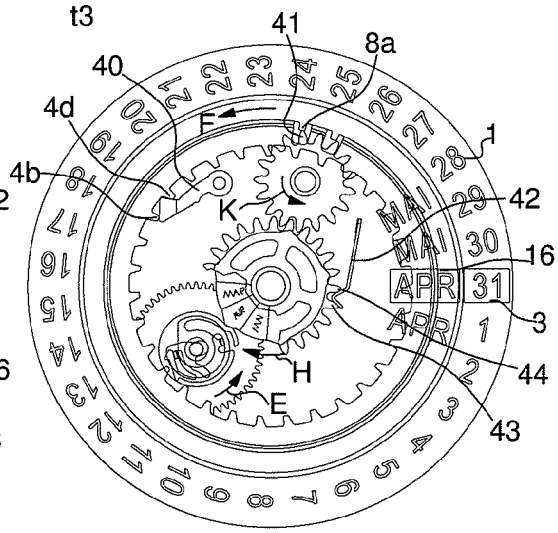
FIGS. 8*a* and 8*b* show the situation of the device on 1 May at 0000 hours at time t3.

FIGS. 8*a* and 8*b* show the situation of the device at time t3, i.e. on 1 May at 0000 hours. As it continues to rotate in the direction of arrow F, tooth 8*a* of ring 1 still drives intermediate wheel 13 in the direction of arrow K and star wheel 12 in the direction of arrow H, until jumper spring 42 pushes tooth 43 in the same direction and is positioned between teeth 43 and 44 of said star wheel. In rotating, the projecting portion 30 of cam 11 has entered into contact with the bottom of heel 29 of mechanism 10. The number 30 has completely disappeared from aperture 3, which allows the number 31 to appear in aperture 3 and the second word APR appears in its entirety in aperture 16. Finger 6 has been completely released from tooth 4 of ring 1 and jumper spring 40 has fallen back between teeth 4*b* and 4*d* of ring 1 to index said ring properly.

Figures 9B, 10B, 11B, 12B:
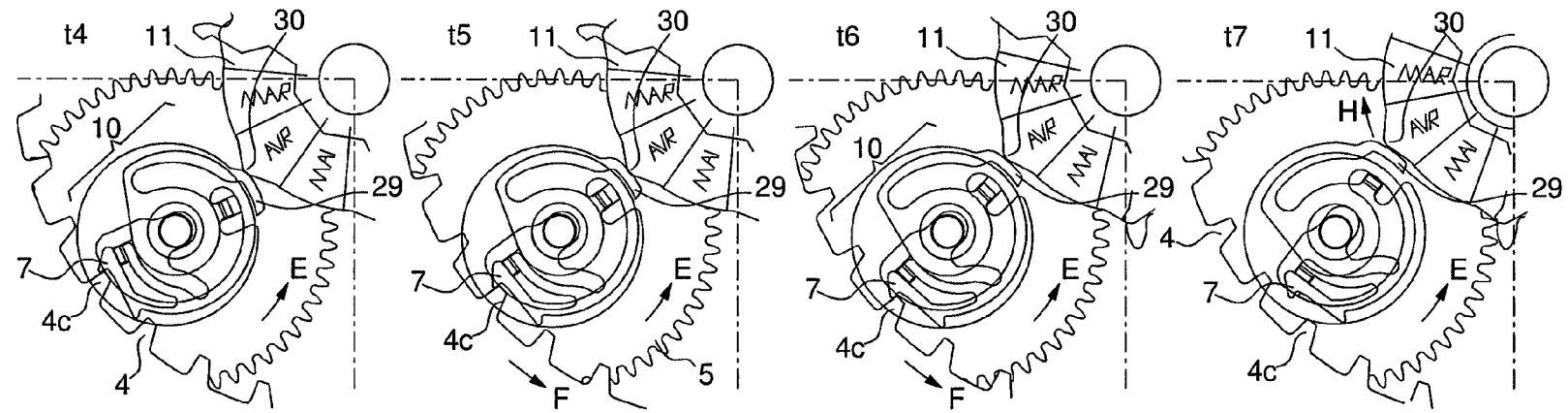
FIGS. 9*a* and 9*b* show the situation of the device on 1 May at 0030 hours at time t4.
FIGS. 10*a* and 10*b* show the situation of the device on 1 May at 0115 hours at time t5.
FIGS. 11*a* and 11*b* show the situation of the device on 1 May at 0200 hours at time t6.
FIGS. 12*a* and 12*b* show the situation of the device on 1 May at 0230 hours at time t7.
Figure 9A:
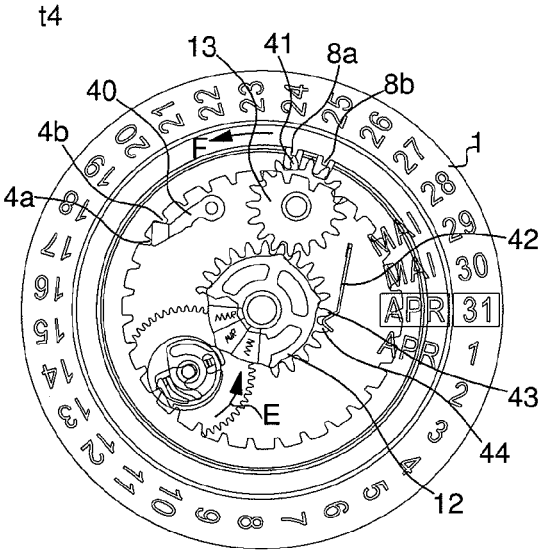

FIGS. 9*a* and 9*b* show the situation of the device at time t4, i.e. on 1 May at 0030 hours. In rotating in the direction of arrow E, heel 29 of mechanism 10 has climbed projecting portion 30 of cam 11, which has the effect of pushing finger 7 of said mechanism into the trajectory of teeth 4 of ring 1, as explained above when the mechanism was described with reference to FIGS. 3 and 4. Finger 7, as shown in FIG. 9*b*, then abuts against tooth 4*c* of ring 1. At this point, neither ring 1, nor disc 16 has moved.

Figure 10A:
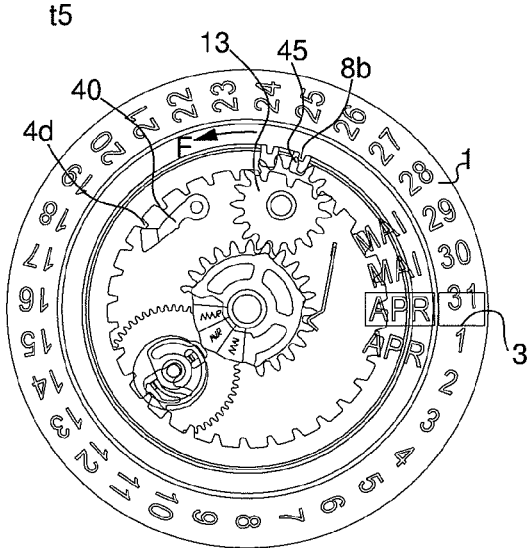

FIGS. 10*a* and 10*b* show the situation of the device at time t5, i.e. on 1 May at 0115 hours. As it continues to rotate in the direction of arrow E, drive wheel 5, still in mesh with tooth 4*c* of ring 1, via finger 7 of mechanism 10, moves said ring forward in the direction of arrow F, with projecting portion 30 of cam 11 still abutting on heel 29 of mechanism 10. Here, tooth 8*b* of the toothing 8 of ring 1 abuts against tooth 45 of intermediate wheel 13 but without driving it yet. The number 31 starts to disappear from aperture 3. Finally, jumper spring 40 starts to climb tooth 4*d* of ring 1.

Figure 11A:
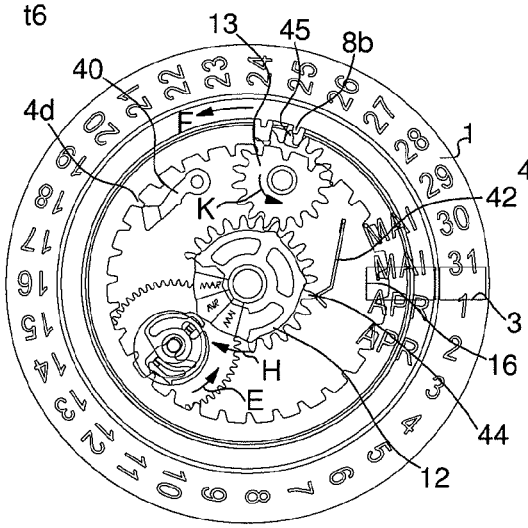

FIGS. 11*a* and 11*b* show the situation of the device at time t6, i.e. on 1 May at 0200 hours. In rotating in the direction of arrow F, via tooth 8*b* of toothing 8, ring 1 drives intermediate wheel 13 in the direction of arrow K, which in turn drives star wheel 12 and month disc 14 in the direction of arrow H. The word APR starts to disappear giving way to the word MAI (MAY) in aperture 16. In rotating in the direction of arrow F, ring 1 causes the number 31 to disappear and introduces the number 1 into aperture 3, via the action of finger 7 of tooth 4*c* of ring 1. Projecting portion 30 of cam 11 still abuts on heel 29 of mechanism 10.

Figure 12A:
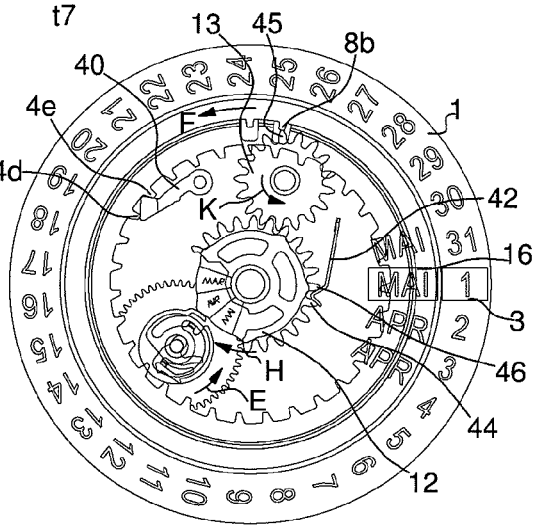

FIGS. 12*a* and 12*b* show the end of the change from a month of less than thirty-one days to the following month at time t7, i.e. on 1 May at 0230 hours. Tooth 8*b* of toothing 8 has finished driving tooth 45 of intermediate wheel 13 in the direction of arrow K. In doing so, said intermediate wheel has rotated star wheel 12 in the direction of arrow H and month disc 14, which is connected thereto. Jumper spring 42 then penetrates between teeth 44 and 46 of star wheel 12 and definitively positions the word MAI in aperture 16. By rotating in the direction of arrow H, cam 11 has released projecting portion 30 from heel 29 and finger 7 is then pushed back out of the trajectory of teeth 4 of ring 1. Likewise, by rotating in the direction of arrow F, jumper spring 40 finishes pushing ring 1, which is positioned between teeth 4*d* and 4*e* and which then shows the number 1 in aperture 3.

In addition to the energy saving provided by the device of the invention which was set out above, the explanation that has just been given demonstrates that said device needs only two jumper springs, one 40 acting on teeth 4 of date ring 1 and the other 42 acting on month star wheel 12.

What is claimed is:

1. An annual calendar device for a timepiece including a date ring bearing thirty-one numbers, which appear in succession through an aperture, said ring carrying thirty-one inner teeth located on a first level, a drive wheel for the date ring completing one revolution in twenty-four hours, and a mechanism carried by said drive wheel and rotating therewith, wherein said mechanism has a first finger driving a tooth of the date ring through one step, at the end of each day, wherein said mechanism has a second finger driving the date ring through an additional step at the end of the last day of a month of less than thirty-one days, said second finger being activated, for the purpose of said driving, by a toothing, located on a second level of the date ring, said second finger being connected to said toothing by a gear train, wherein said gear train comprises said mechanism including said first and second fingers, a month cam with five projecting portions activating second finger via said mechanism, a month star wheel fixed said cam and an intermediate transmission wheel meshing with said star wheel, and wherein said intermediate wheel is in mesh, at the end of each month, with said toothing.

2. The device according to claim 1, wherein the star wheel fixed the cam carries a disc on which are marked the names of the months, said names appearing in succession through an aperture.

3. The device according to claim 1, wherein the mechanism, carried by the drive wheel of the date ring, includes a first plate fixed to the arbour carried by said wheel, the periphery of said plate having a tongue from which said first and second fingers extend, said second finger being arranged at the end of said tongue, and a second plate arranged on the first and capable of moving diametrically relative to the drive wheel, said second plate having a first catch passing through the first plate, in proximity to the back of the second finger, then a first oblong aperture made in the drive wheel, and a second catch diametrically opposite the first catch, said second catch passing through the first plate in proximity to the back of said tongue, then a second oblong aperture made in the drive wheel, said second plate finally having a heel diametrically opposite the first catch and the second finger, said heel being located in the trajectory of the projecting portions of the cam and causing the second finger to enter the trajectory of the teeth of the date ring, when said heel is pushed by a projecting portion of the cam.

4. The device according to claim 1, further comprising a first jumper spring acting on the inner teeth of the date ring and a second jumper spring acting on the teeth of the month star wheel.

* * * * *